US005276286A

United States Patent [19]

Demissy et al.

[11] Patent Number: 5,276,286

[45] Date of Patent: Jan. 4, 1994

[54] EXPOSED HIGH VOLTAGE OUTDOOR DISCONNECTOR FOR OPERATION UNDER ICING CONDITIONS

[75] Inventors: Daniel Demissy, Montreal; Gaétan Daigneault, St-Hubert, both of Canada

[73] Assignee: Gec Alsthom Energie Inc., Laprairie, Canada

[21] Appl. No.: 936,213

[22] Filed: Aug. 27, 1992

[30] Foreign Application Priority Data

Aug. 28, 1991 [FR] France ..... 91 10680

[51] Int. Cl.[5] ..... H01H 33/12; H01H 9/38; H01H 33/66

[52] U.S. Cl. ..... 200/146 R; 200/144 B

[58] Field of Search ..... 200/146

[56] References Cited

U.S. PATENT DOCUMENTS

| | | | |
|---|---|---|---|
| 3,171,004 | 2/1965 | Luehring | 200/146 R |
| 3,560,682 | 2/1971 | Kohler et al. | 200/144 B |
| 3,883,709 | 5/1975 | Cole | 200/144 B |
| 4,103,122 | 7/1978 | Albright et al. | 200/48 P |

FOREIGN PATENT DOCUMENTS 0092205 10/1983 European Pat. Off. .

*Primary Examiner*—J. R. Scott

*Attorney, Agent, or Firm*—Sughrue, Mion, Zinn Macpeak & Seas

[57] ABSTRACT

An outdoor grounding section switch has a female contact and a male contact at the end of a grounding blade that can be driven. The female contact is constituted by at least one hollow tubular thimble (11, 15), housed inside a vertical tubular insulator (3) that is closed at its top end and open at a bottom end. The male contact (25) is a vertical cylinder penetrating into the insulator (3) and the thimble during closing. The open end of the insulator (3) is equipped with a metal part (14), the inside of which is provided with a plurality of radially-directed lugs (14A), facing the periphery of the male contact vertical cylinder and stopping short of the vertical cylinder to break ice accumulating off the end of the male contact during section switch closure. A quick-break vacuum switch is connected in parallel with the ends of the thimble (11, 15) controlled by the displacement of the section switch male contact through an over center, quick-break mechanism so that the quick-break vacuum switch opens after the male and female contacts of the section switch separate from each other by an isolation distance.

9 Claims, 4 Drawing Sheets

EXPOSED HIGH VOLTAGE OUTDOOR DISCONNECTOR FOR OPERATION UNDER ICING CONDITIONS

FIELD OF THE INVENTION

The present invention relates to a grounding section switch having interrupting power known as a high voltage disconnector.

The present invention relates more precisely to an outdoor grounding section or disconnector switch including a female contact and a male contact at the end of a grounding blade that can be driven.

BACKGROUND OF THE INVENTION

An object of the invention is to provide an outdoor grounding section or disconnector switch that can operate under ice, without it being necessary to heat its switching members. Such a section switch must be capable of operating under 20 mm of ice, at temperatures down to −50° C.

SUMMARY OF THE INVENTION

To this end, in accordance with the invention, the female contact of the section switch, constituted by at least one thimble, is housed inside a vertical tubular insulator that is closed at its top end, and the male contact is a vertical cylinder penetrating into the insulator during closing, the opening in the insulator being equipped with a metal part the inside of which is provided with a plurality of radially-directed lugs.

Because they are directed radially, the lugs break through any ice which may be deposited on the end of the male contact when the section switch is in the open position. On section switch closing, the ice is broken and falls away before the male contact penetrates into the thimble. The fact that the female contact is disposed vertically with its opening facing downwards ensures that the broken ice does fall away.

Preferably, in order to optimize ice-breaking, the inside edges of the lugs are sloping, the distance between the edges and the vertical axis of symmetry of the insulator charging from the bottom to the top, up to a distance that is substantially equal to the radius of the male contact.

In accordance with another characteristic, the section switch includes a quick-break vacuum switch connected in parallel with the ends of the female contact, and means controlled by the displacement of said male contact for opening the vacuum switch while the section switch is opening, when the female contact of the section switch and said male contact are separated from each other by an isolation distance.

Certain constraints on operating an electricity grid can lead to a grounding section switch being opened even while the line is conveying some residual current. In this way, the section switch is provided with sufficient interrupting power to enable it to be opened quite safely even when the line is carrying residual current.

In a particular embodiment, the quick-break switch comprises a vacuum switch.

The quick-break mechanism for controlling the vacuum switch comprises a link provided with a lug cooperating with an aperture in the end of the moving contact of the switch, said link being biased by a spring and connected to an arm driven by a lever secured to the grounding blade.

The female contact of the section switch comprises two thimble contacts separated from each other by a length of not less than the isolation distance.

The male contact includes bulges engagable with the thimble contacts to provide electrical connection therewith.

The quick-break switch is disposed inside a casing made of an insulating material, such as porcelain.

The switch and the female contact are connected together in parallel via a cross-bar and via a resistive braid.

The present invention is made clearer by the following description of a particular embodiment of the invention, given with reference to the accompanying drawings, in which:

DESCRIPTION OF THE PREFERRED EMBODIMENT

Figure 1:
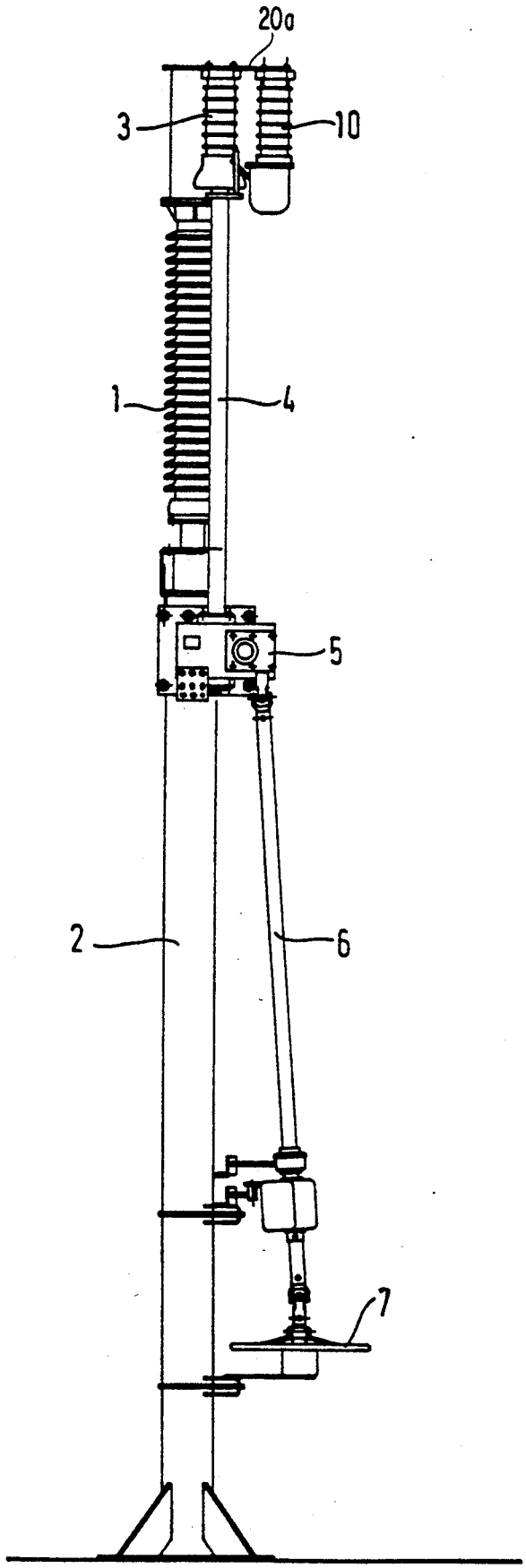
FIG. 1 is an elevation view of a grounding section or high voltage disconnector switch forming a preferred embodiment of the invention.

In FIG. 1, reference 1 designates an insulating column disposed at the top of a metal structure 2 serving as a support.

A section switch or high voltage disconnector 8 includes an insulator 3 housing the female contact of the section switch, or interrupter switch 8 placed at the end of the column. The male contact is placed at the end of a grounding blade 4 which can be moved in translation along its axis by means of a mechanism 5 comprising an arm 6 which can be rotated by means of a handwheel 7. All the preceding components are well known and are therefore not described in more detail.

Figure 3:
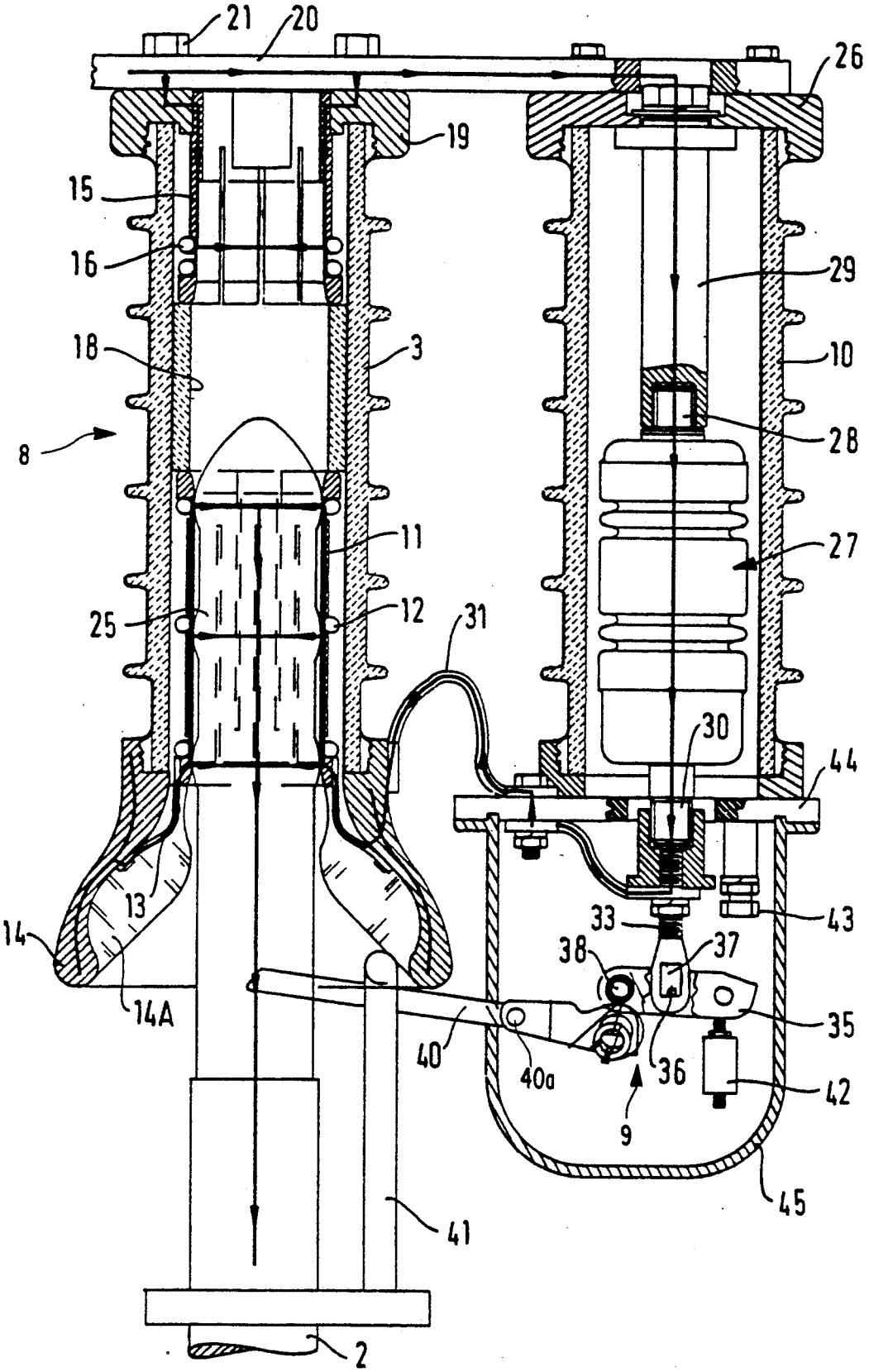
FIG. 3 is a view similar to the preceding view, but while the section switch is opening.
Figure 4:
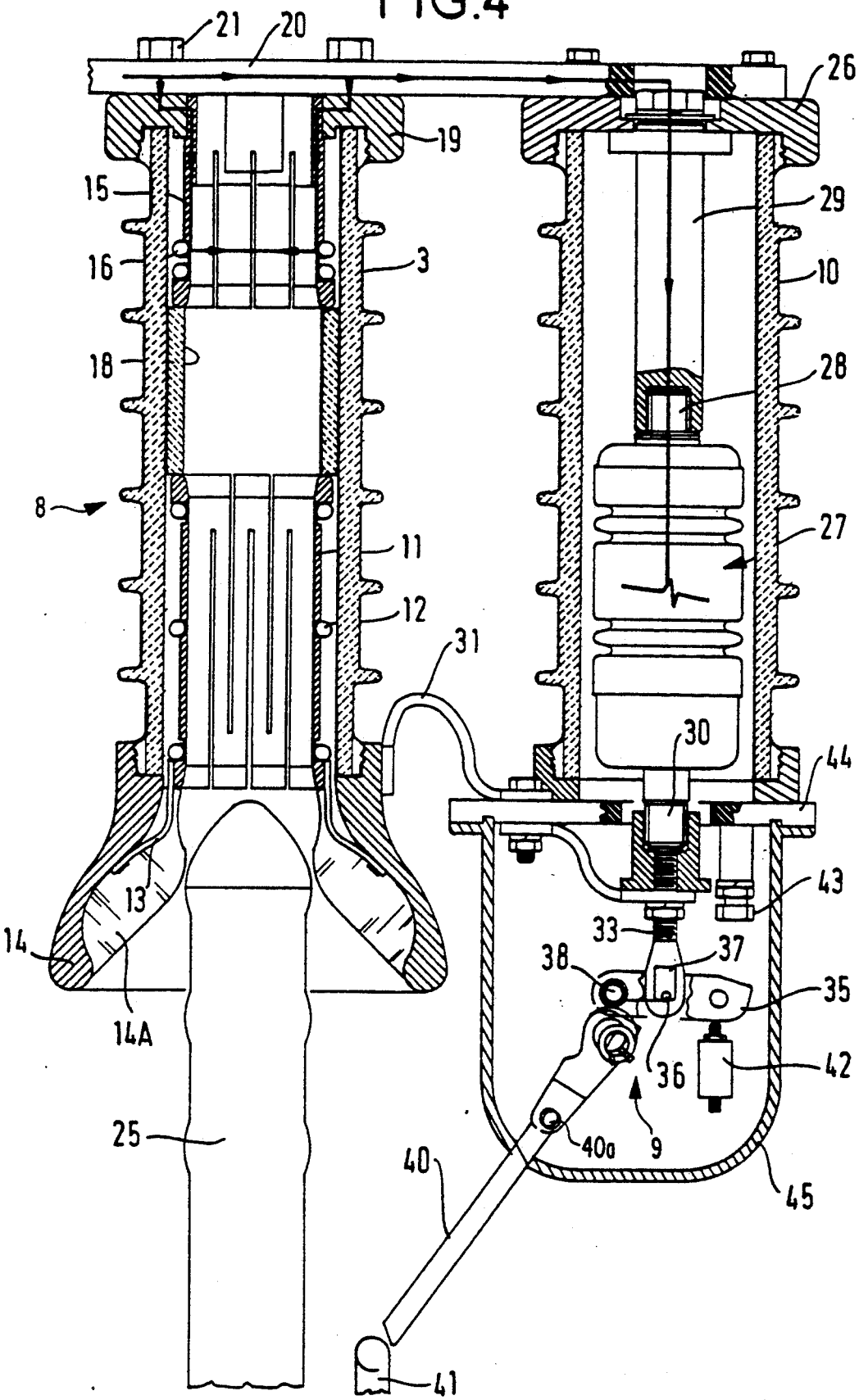
FIG. 4 is a view similar to the preceding view, but after the section switch has opened.

Reference 10 designates the casing of a mechanism which is described in detail with reference to FIGS. 2 to 4, and which makes it possible to given the section or high voltage disconnector switch the desired interrupting power.

Figure 2:
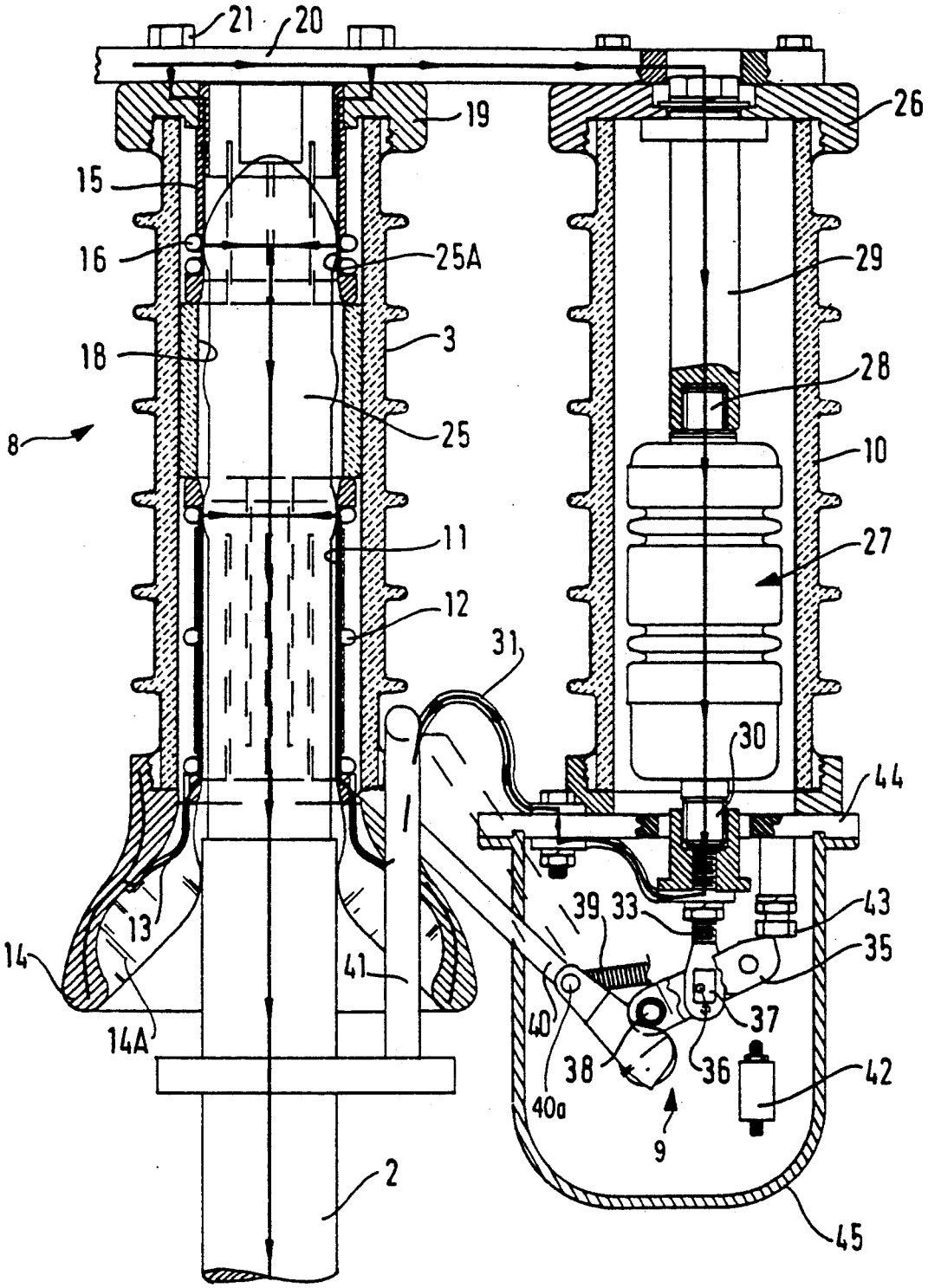
FIG. 2 is an enlarged view showing a section through the end of the section switch when it is in the engaged position.

Casing 3 shown in the enlarged view in FIG. 2 is preferably made of porcelain and is provided with fins. Inside casing 3, there is a first thimble-type metal contact 11 constituted by a tube provided with longitudinal slots that define contact fingers clamped by springs such as 12. The first metal contact 11 is connected via braids to a metal part 14 serving as an insertion guide for the male contact of the section switch. The inside of the part 14 is provided with a plurality of radial lugs 14A designed to break any ice which may have been deposited on the end of the male contact 25 of the section switch while the section switch was in the open position. On section switch closing, the ice breaks and falls away before the male contact penetrates into the thimble. The fact that the female contact is disposed vertically with is opening facing downward ensures that the broken ice does fall away.

A second thimble-type metal contact 15 equipped with springs 16 is disposed inside casing 3. Contact 11 and contact 15 may be separated axially from each other by a sleeve 18 made of an insulating material. Contact 15 is both mechanically and electrically secured to an annular metal block 19 to which the column 3 is fixed. The block 19 is fixed to a metal cross-bar 20 by means of a screw 21. The cross-bar 20 is connected to a terminal 20A of the section switch.

The section switch male contact 25 disposed at the end of the grounding blade 2 is a cylinder having radially outward bulges 25A which co-operate with the thimble contacts to make electrical contact therewith. The various lengths of the thimbles and the insulating portion 18, and also the disposition of the bulges, are chosen such that, in the closed position, the male contact 25 is in electrical contact both with thimble contact 15, and with thimble contact 11.

In FIG. 2, contact 25 is in electrical contact with thimble 15 because the section switch is in the closed position.

A quick-break vacuum switch 27 is housed in casing 10 made of porcelain and provided with fins, and is fixed to the cross-bar 20 via a metal block 26 which is both mechanically and electrically connected thereto. Casing 10 contains the vacuum switch 27 having its first terminal 28 connected to block 26 via a rod 29, and having its second terminal 30 electrically connected to contact 11 via a resistive metal braid 31. The drive rod 33 of the vacuum switch co-operates with a quick-break drive mechanism 9 controlled by the motion of the grounding blade 2. The quick-break mechanism 9 comprises a link 35 provided with a lug 36 engaged in an aperture 37 in the drive rod 33. The link 35 pivots about a fixed axis 38 and is coupled to an arm 40 via a pin 40*a* to which is connected one end of a spring 39. The arm 40 can be displaced by moving a movable lever 41 which is fixed to the blade 2. The quick-break mechanism 9 further comprises both a fixed first abutment 42 and also an adjustable abutment 43 for the link 35.

The vacuum switch 27 is supported by a plate 44 fixed to the casing 10, the plate also carrying a protective metal cover 45.

The apparatus operates as follows.

When the section switch 8 is in the engaged position (FIG. 2), the current flows mainly via terminal 20A, cross-bar 20, block 19, contact 15, contact 25, and grounding blade 2. A small portion of the current is diverted via cross-bar 20, rod 29, vacuum switch 27 which is in the closed position, terminal 30, braid 30, braid 31, contact 11, and contact 25.

At the beginning of the displacement of the grounding blade 2, the male contact 25 leaves thimble contact 15. The current is switched to the circuit comprising rod 29, vacuum switch 27, braid 31, contact 11, contact 25 and grounding blade 2.

The two thimble contacts are far enough apart to avoid any re-arcing on circuit opening.

During the movement of the blade, the lever 41 is displaced and it starts to drive the arm 40.

The grounding blade continues to more, the arm 40 goes past its dead center, thereby causing the link 35 to toggle, and the vacuum switch to open. The moving contact of the vacuum switch can be displaced at a speed of about 1 meter/second (m/s) which is sufficient for good operation of the apparatus.

The continuing movement of the grounding blade (FIG. 4) causes the vacuum switch 27 to be re-closed, with the section switch 8 ending its opening stroke.

On section switch 8 closing, the end of contact 25 and the guide 14 withstand the pre-strike arc. The re-establishment current flows through the vacuum switch until contact 25 comes into contact with thimble 15, and this causes the vacuum switch to be put back in parallel.

It will be observed that the through resistance of the vacuum switch and of the braid 31 is substantially higher than that offered by the contacts 25-15, so that the current passing through the vacuum switch stays very low permanently.

The restrictive braid 31 prevents any excessively high diverted current from passing to the vacuum switch.

In this way, in the closed position, short-circuit power of about 100,000 A/second is obtained whereas the vacuum switch withstands only 6,000 A/second using a resistivity ratio of 20:1 on the vacuum switch side.

The resistive component serving to calibrate the ratio is essentially the braid 31.

In the above-mentioned embodiment, a vacuum switch is described which is actuated by means of a quick-break mechanism. Naturally, the invention is not limited to this embodiment, and it also relates to using a quick-break switch or a breaker.

The invention applies to high-tension and very-high-tension grounding section switches.

We claim:

1. In an outdoor grounding section switch subject to icing and including a fixed female contact and a movable male contact at the end of a grounding blade that can be driven, the improvement wherein the female contact is constituted by at least one hollow tubular thimble (11, 15) housed inside a fixed vertical tubular insulator (3), said tubular insulator being closed at a top end thereof and open at a bottom end thereof, said male contact (25) being a vertical cylinder penetrating into the insulator (3) and into the interior of said at least one thimble during closing, and the open bottom end of the insulator (3) being equipped with a tubular metal part (24), the inside of which is provided with a plurality of radially-directed lugs (14A) facing the periphery of the male contact vertical cylinder and terminating short of the vertical cylinder, whereby ice accumulating on the end of the male contact is broken up by said lugs during section switch closing.

2. A section switch according to claim 1, wherein said lugs have inside edges which are sloped, with the distance between the edges and the vertical axis of symmetry of the insulator (3) tapering inwardly going from the bottom to the top to a distance that is substantially equal to the radius of the male contact.

3. A section switch according to claim 1, further comprising a quick-break switch (27, 35, 39, 40) connected in parallel with opposite ends of the female contact (15) of the section switch, and lever means (41) responsive to the displacement of said male contact for opening said quick-break switch during section switch opening, after said female contact and said male contact of the section switch are separated from each other by an isolation distance.

4. A section switch according to claim 3, wherein said quick-break switch comprises a vacuum switch (27).

5. A section switch according to claim 4, wherein a quick-break mechanism for controlling opening and closing of the vacuum switch comprises a link (35) provided with a lug (36) engaging with an aperture (37) in the end of the moving contact of the quick-break switch, said link being biased by a spring (39) and being connected to an arm (40) driven by the lever means secured to the grounding blade (2).

6. A section switch according to claim 3, wherein the quick-break switch comprises a vacuum switch disposed inside a casing (10) made of an insulating material, such as porcelain.

7. A section switch according to claim 3, wherein the quick-break switch and the female contact (11, 15) are connected in parallel via a cross-bar (20) and via a resistive braid (31).

8. A section switch according to claim 1, wherein the female contact comprises two thimble contacts (11, 15) axially separated from each other by a length of not less than the isolation distance.

9. A section switch according to claim 8, wherein the male contact (25) includes bulges (25A) engagable with the thimble contacts to provide electrical connection therewith.

* * * * *